US005228463A

United States Patent [19]

Fournier et al.

[11] Patent Number: 5,228,463

[45] Date of Patent: Jul. 20, 1993

[54] MAGNESITE/MAGNESIUM HYDROXIDE FILLERS FOR SMOKING ARTICLE WRAPPERS

[75] Inventors: Jay A. Fournier, Richmond; Andrew G. Kallianos; John B. Paine, III, both of Midlothian; Kenneth F. Podraza; Jeffrey I. Seeman, both of Richmond, all of Va.

[73] Assignee: Philip Morris Inc., New York, N.Y.

[21] Appl. No.: 800,053

[22] Filed: Nov. 27, 1991

[51] Int. Cl.[5] ..... A24D 1/02

[52] U.S. Cl. ..... 131/365; 162/8; 162/139

[58] Field of Search ..... 131/365, 358; 162/8, 162/139

[56] References Cited

U.S. PATENT DOCUMENTS

| | | |
|---|---|---|
| 2,673,565 | 3/1954 | Schur et al. . |
| 2,801,636 | 8/1957 | Pfoh . |
| 3,744,496 | 7/1973 | McCarty et al. . |
| 3,931,824 | 1/1976 | Miano et al. . |
| 4,129,134 | 12/1978 | Hind et al. . |
| 4,225,636 | 9/1980 | Cline et al. . |
| 4,231,377 | 11/1980 | Cline et al. . |
| 4,420,002 | 12/1983 | Cline . |
| 4,433,697 | 2/1984 | Cline et al. . |
| 4,450,847 | 5/1984 | Owens . |
| 4,622,983 | 11/1986 | Mathews et al. . |
| 4,805,644 | 2/1989 | Hampl, Jr. et al. . |
| 4,881,557 | 11/1989 | Martin . |
| 4,941,486 | 7/1990 | Dube et al. . |
| 4,984,589 | 1/1991 | Riedesser . |
| 5,131,416 | 7/1992 | Gentry ..... 131/365 |

FOREIGN PATENT DOCUMENTS

| | | |
|---|---|---|
| 702920 | 2/1965 | Canada . |
| 0290911 | 11/1988 | European Pat. Off. . |
| 0338156 | 10/1989 | European Pat. Off. . |
| 1289766 | 9/1972 | United Kingdom . |
| 2160084 | 12/1985 | United Kingdom . |
| 2191930 | 12/1987 | United Kingdom . |
| 2209267 | 5/1989 | United Kingdom . |

OTHER PUBLICATIONS

CA 91(24):196071v [Shlyapnikov, D. S. et al., "Investigation Of The Composition of Solid Phases In The Systems $MgO—CO_2—H_2O$ And $MgO—CO_2—H_2O$ And $MgO—Mg(HCO_3)_2$ |$NaHCO_3$|$-H_2O$ At 150° and 250° C., " pp. 706-711 (1979)].

CA 93(12): 117381m [Shlyapnikov, D. S. et al., "Magnesium Carbonates In The $MgO—H_2O—CO_2$ System At Temperatures Of 25°, 150°, and 250° C., " pp. 132-134].

CA 93(16): 1532992 [Shlyapnikov, D. S. et al., "Conversion Of Hydromagnesite Into Magnesite And Brucite At 150°-200° C. In Water And In An Anhydrous Medium (Based On Experimental Data)," pp. 962-966 (1980)].

*Primary Examiner*—V. Millin
*Assistant Examiner*—J. Doyle
*Attorney, Agent, or Firm*—Michael P. Morris; John M. Hintz

[57] ABSTRACT

The invention relates to the use of co-crystalline magnesite/magnesium hydroxide compositions as fillers for smoking article wrappers. Smoking articles made with wrappers containing these compositions exhibit significantly reduced sidestream smoke and does not compromise subjective attributes.

36 Claims, 6 Drawing Sheets

MAGNESITE/MAGNESIUM HYDROXIDE FILLERS FOR SMOKING ARTICLE WRAPPERS

TECHNICAL FIELD OF THE INVENTION

The invention relates to compositions which may be used novelly as fillers for smoking article wrappers. In particular, this invention relates to compositions comprising crystalline magnesite and crystalline magnesium hydroxide which, when used as fillers in the fabrication of smoking article wrappers, produce significantly reduced sidestream smoke.

BACKGROUND OF THE INVENTION

Sidestream smoke is the smoke given off by the burning of a cigarette or cigarette-like smoking article between puffs. Such smoke may be objectionable to those near the smoker who are not smoking or who do not smoke.

Several attempts have been made to reduce sidestream smoke through the use of various compounds, e.g., magnesium hydroxide, as cigarette paper fillers. See, e.g., U.S. Pat. Nos. 4,941,485, 4,915,118, 4,881,557, 4,450,847 and 4,433,697. While magnesium hydroxide reduces sidestream smoke, its incorporation into smoking article wrappers can result in a cigarette with unacceptably poor taste. Others have used physical mixtures of magnesium hydroxide or an unspecified "magnesium carbonate" composition with other compounds such as calcium carbonate in smoking article wrappers. See, e.g., U.S. Pat. No. 4,984,589 disclosing a 2 layer wrapper construction. Some have even tried flavoring agents to mask the poor taste. However, none of these attempts to reduce sidestream smoke while maintaining positive subjective taste attributes have met with success.

It is therefore an object of this invention to provide a smoking article having a wrapper designed to reduce sidestream smoke without adversely affecting the consumer's subjective taste perception of the cigarette.

It is another object of this invention to provide compositions comprising high levels of a co-crystalline form of magnesium carbonate and magnesium hydroxide as a novel filler in a cigarette wrapper without adversely affecting the consumer's subjective taste perception of the cigarette.

SUMMARY OF THE INVENTION

This invention relates to compositions comprising crystalline magnesite and crystalline magnesium hydroxide which may be used novelly as fillers for smoking article wrappers. Smoking articles made with the wrappers containing these compositions exhibit significantly reduced sidestream smoke without adversely compromising subjective taste attributes.

The sample analyzed was obtained from the filler described in Example 2.

Figure 3:
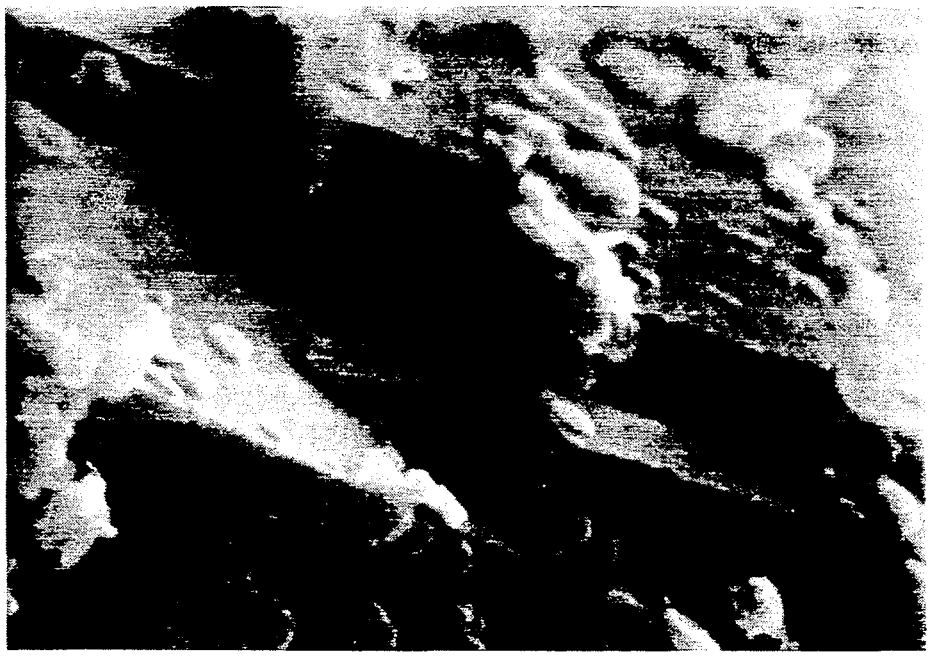

FIG. 3 is an electron micrograph of a filler composition of the invention. The sample analyzed was obtained from the filler described in Example 1.

Figure 4:
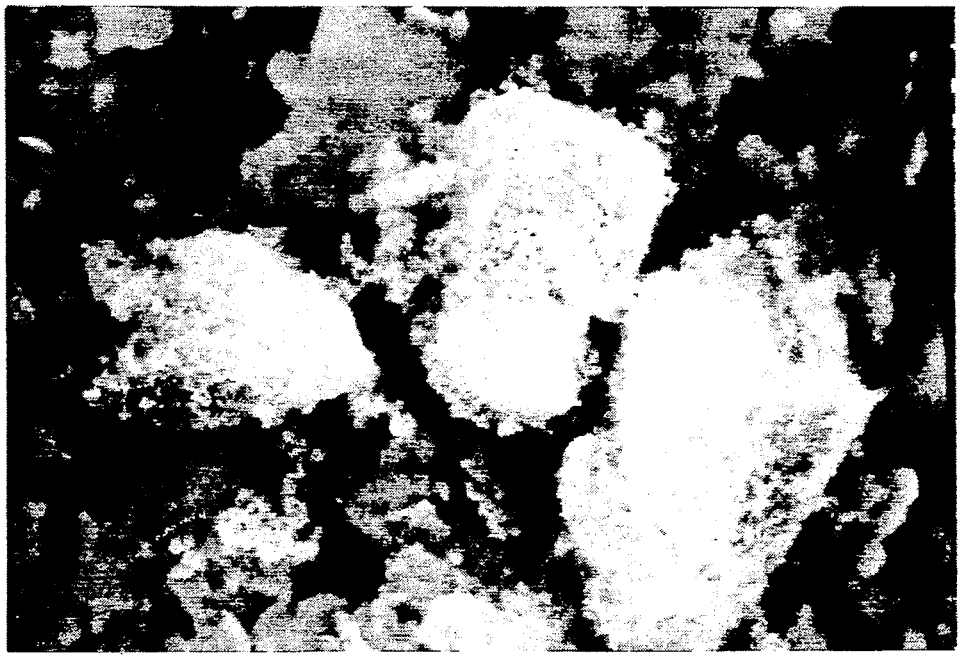

FIG. 4 is an electron micrograph of a filler composition of the invention. The sample analyzed was obtained from the filler described in Example 2.

Figure 5:
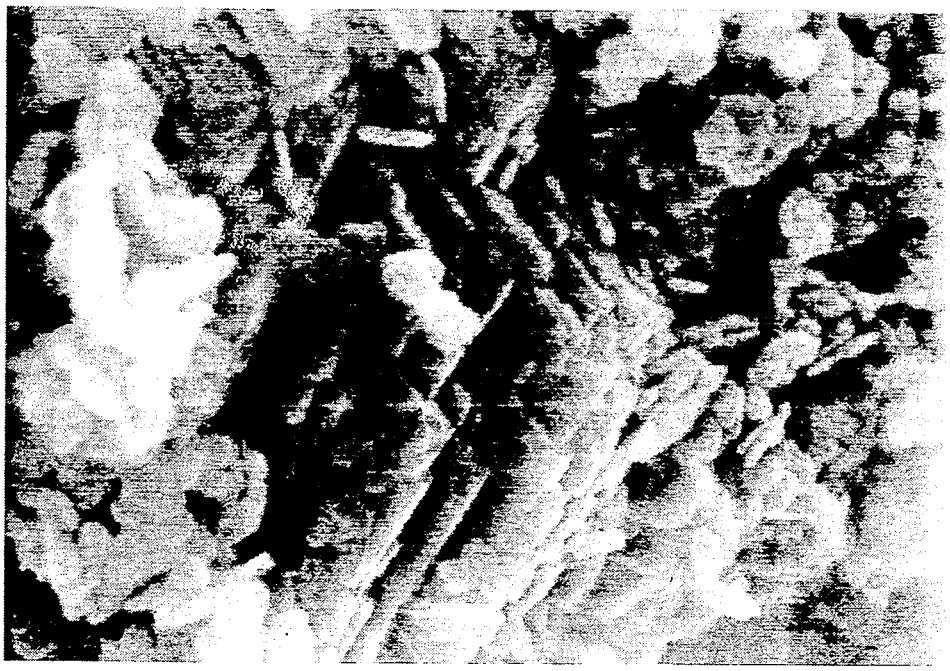

FIG. 5 is an electron micrograph of a filler composition of the invention. The sample analyzed was obtained from the filler described in Example 3.

Figure 6:
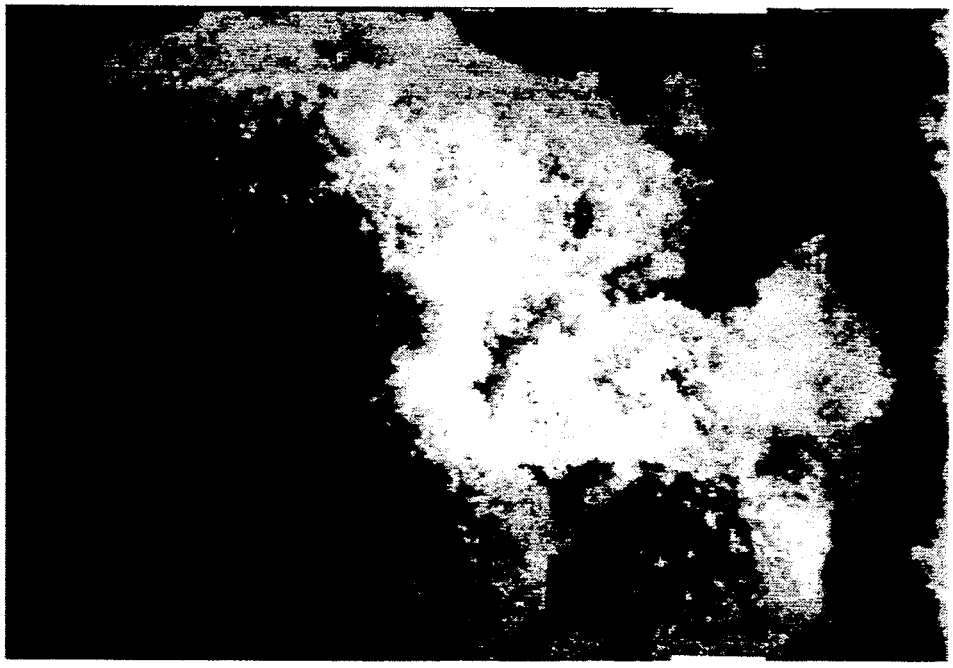

FIG. 6 is an electron micrograph of a filler composition of the invention. The sample analyzed was obtained from the filler described in Example 4.

Figure 7:
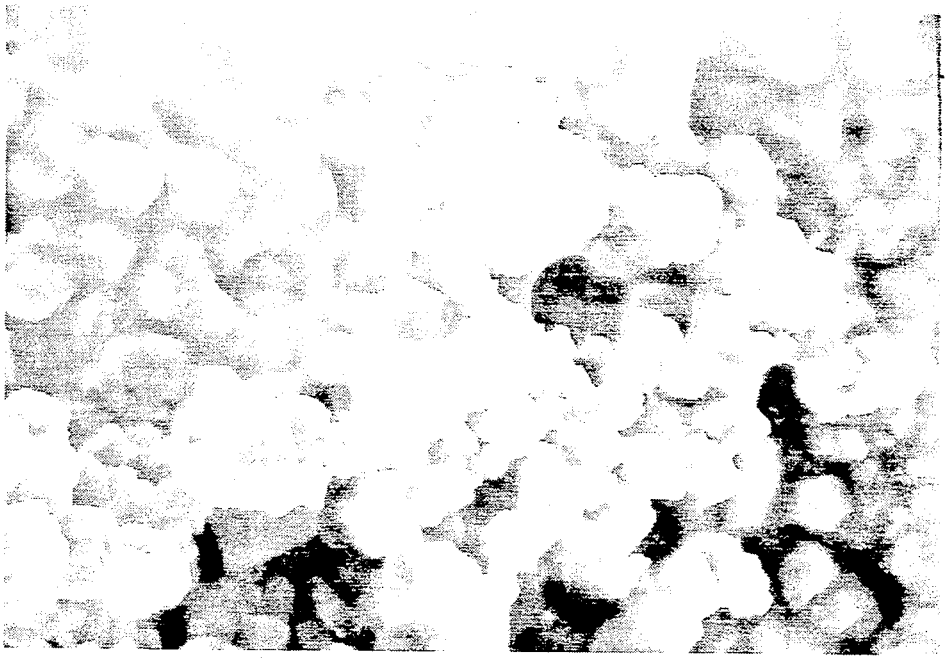

FIG. 7 is an electron micrograph of a filler composition of the invention. The sample analyzed was obtained from the filler described in Example 5.

Figure 8:
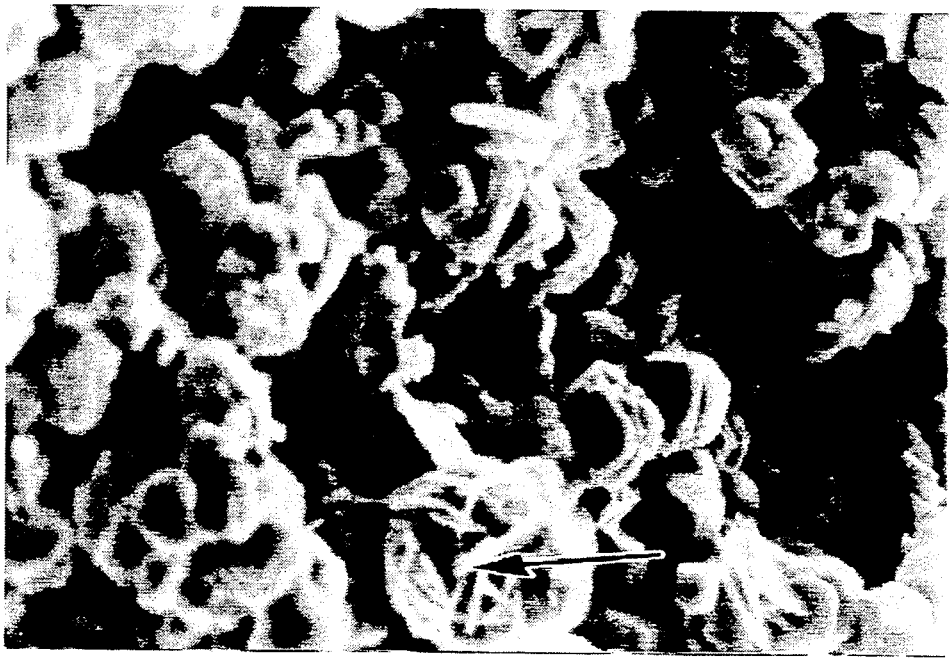

FIG. 8 is an electron micrograph of a filler composition of the invention. The sample analyzed was obtained from the filler described in Example 6.

Figure 9:
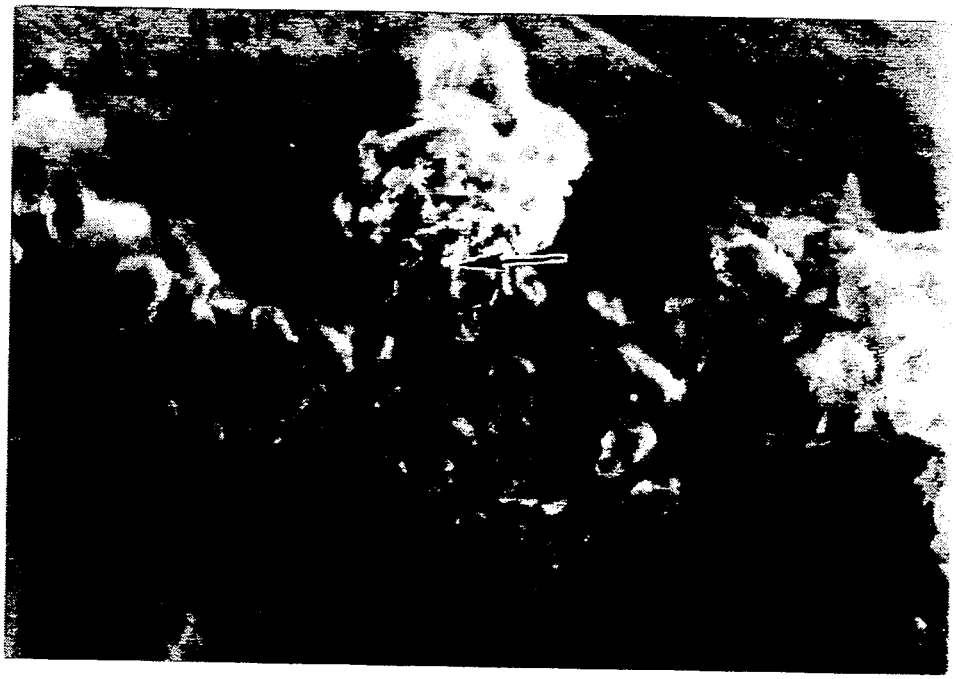

FIG. 9 is an electron micrograph of a filler composition of the invention. The sample analyzed was obtained from the filler described in Example 7.

Figure 10:
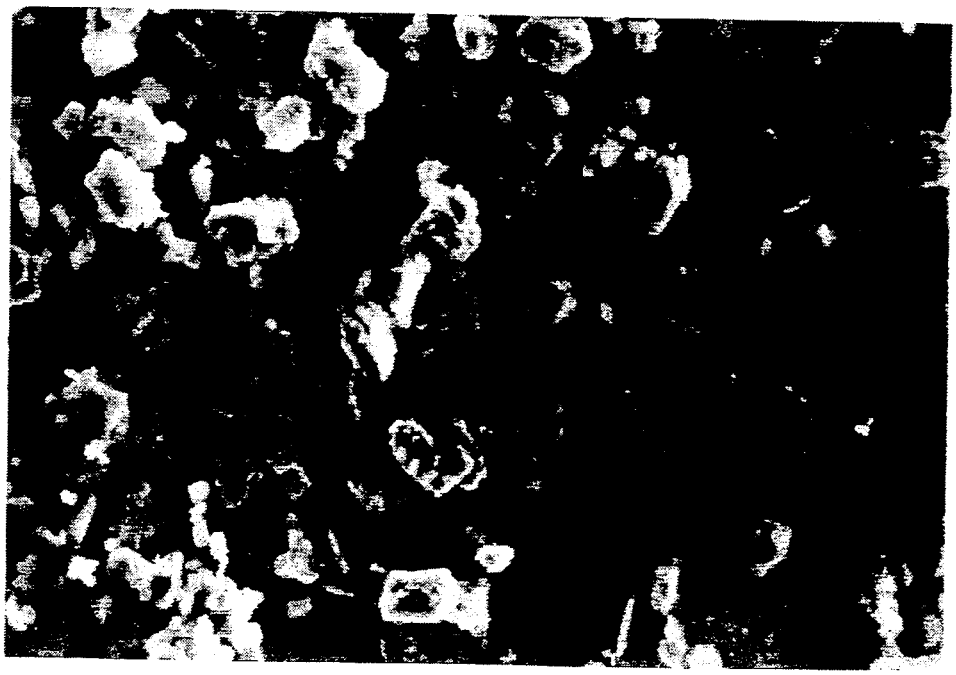

FIG. 10 is an electron micrograph of a filler composition of the invention. The sample analyzed was obtained from the filler described in Example 8.

DETAILED DESCRIPTION OF THE INVENTION

In order that the invention herein described may be more fully understood, the following detailed description is set forth. For convenience, the references cited in the detailed description of the invention are listed immediately preceding the claims.

The present invention relates to compositions which may be used as novel fillers for smoking article wrappers for tobacco and tobacco-containing products. As used herein the term tobacco includes not only cut tobacco leaf filler usually found in cigarettes, but also includes expanded tobacco, extruded tobacco, reconstituted tobacco, tobacco stems, tobacco substitutes and synthetic tobacco. A tobacco rod includes any substantially cylindrical tobacco-containing smoking article, e.g., a cigarette.

In the context of this invention the term magnesite refers to the compound which corresponds exactly to the chemical formula $MgCO_3$. Magnesium carbonate which is generally distributed or available commercially is actually equivalent to the mineral hydromagnesite having the general chemical formula $Mg_5(CO_3)_4(OH)_2.4H_2O$. This is chemically, physically, and structurally different than magnesite ($MgCO_3$) Magnesite is readily distinguished from hydromagnesite by x-ray diffraction analysis, thermogravimetric analysis or elemental analysis.

It should be appreciated that magnesite is a very specific mineral form of magnesium carbonate and that synthetic magnesite is not a common item of commerce. Although synthetic magnesite can be prepared by hydrothermal procedures, examples of which are disclosed herein, it should further be appreciated that, in addition to hydromagnesite mentioned above, there are other forms of magnesium carbonate. However, the only one which compositionally corresponds to the exact molecular formula of $MgCO_3$ is magnesite. As such, it is a distinct and specific form of magnesium carbonate. Unless specifically described as magnesite, all other forms of magnesium carbonates [e.g., artinite ($Mg_2(CO_3)(OH)_2.3H_2O$), dypingite ($Mg_5(CO_3)_4(OH)_2.5H_2O$), giorgiosite ($Mg_5(CO_3)_4(OH)_2.5H_2O$), hydromagnesite ($Mg_5(CO_3)_4(OH)_2.4H_2O$), lansfordite ($MgCO_3.5H_2O$) and nesquehonite ($MgCO_3.3H_2O$)] are not magnesite and do not correspond chemically to the formula $MgCO_3$. Aside from its unique chemical composition, magnesite can be distinguished from other forms of magnesium carbonates by its thermal stability. Magnesite is the most thermally stable form of all the magnesium carbonates, decomposing thermally only when heated above 500° C. All of the other known magnesium carbonates decompose at less than 500° C.

The $Mg(OH)_2$ of this invention is well crystallized and gives a sharp x-ray diffraction pattern. Such crystallized $Mg(OH)_2$ is referred to herein as "brucite".

The compositions of this invention are useful for effecting sidestream smoke reduction when used as novel fillers in the fabrication of smoking article wrappers. Such compositions typically comprise between about 99% and 25% by weight magnesite, and between about 1% and 75% by weight brucite. Preferably, the compositions comprise between about 98% and 40% by weight magnesite, and between about 2% and 60% by weight brucite. These "magnesite/brucite compositions" are well crystallized, and in intimate contact with, and/or adhering to, each other and, therefore, differ from mechanical blends of magnesite and magnesium hydroxide.

The wrappers of the invention comprise ordinary cigarette paper with magnesite/brucite compositions as novel fillers. The concentration of these compositions in the cigarette paper ("the filler loading") may comprise up to about 50% by weight based on the weight of the paper. The filler loading is preferably between about 15% and 45% by weight of the paper with a most preferred filler loading of between about 25% and 35% by weight.

In a preferred embodiment, sizing agents, such as alkali metal salts of acids, are used to adjust or control the static burn rate of the resulting smoking article. Typically, such sizing agents may be added to the wrapper in an amount of between about 2% and 15% by weight, preferably between about 3% and 10% by weight. Particularly good sizing agents include sodium and potassium salts, for example, sodium fumarate, sodium citrate, potassium citrate, potassium succinate, potassium dihydrogen phosphate and combinations thereof. Of these, potassium citrate and potassium succinate are preferred.

The papers of the invention typically have a basis weight of between about 25 and 75 grams per square meter and have a porosity of between about 2 and 15 cubic centimeters per minute per square centimeter as measured by the CORESTA method (CORESTA units). The preferred basis weight of the papers of the invention is between about 35 and 60 grams per square meter and the preferred porosity range is between about 3 and 8 CORESTA units.

The compositions of the invention may be prepared synthetically from any of various starting compounds, for example, magnesium hydroxide, hydromagnesite or magnesium oxide[1,2,3,4]. For example, the compositions of the invention may be prepared by hydrothermally reacting magnesium hydroxide with carbon dioxide to form the magnesite/brucite compositions. These compositions may assume the physical characteristics of aggregates, which have brucite crystals discretely scattered on and adhered to the surface of the magnesite crystals. Adjustments to the size of the reactor, the amount of carbon dioxide in the reaction, the time of the reaction and the pressure and/or temperature of the reaction permits the co-crystallization of such magnesite/brucite "aggregates" in a pre-determined ratio. For example, it is preferred to use less than stoichiometric amounts of carbon dioxide in the reaction to yield a composition having a brucite component. In addition, we prefer to adjust the pressure of the reaction to between about 100 psi and 1000 psi, most preferably between about 500 psi and 850 psi, and the time of the reaction to less than one week, more preferably less than about 72 hours, most preferably between about 10 and 50 hours. The preferred temperature of the reaction is between about 150° C. and 374° C. (the critical temperature of water), most preferably between about 180° C. and 200° C. Such preferred reaction conditions permit the production of co-crystalline aggregates comprising magnesite and brucite.

The compositions of the invention may also be prepared by hydrothermally treating hydromagnesite in the absence of carbon dioxide to produce separate polycrystalline agglomerates of brucite particles interspersed amongst the magnesite particles. Similarly, adjustments to the size of the reactor, and the time and temperature of the reaction permit the production of magnesite/brucite "agglomerates" of varying compositions. The compositions of the invention include the use of such "aggregates" and "agglomerates", alone or in combination with each other, e.g., mechanical blends, as fillers for smoking article wrappers. Preferably, these compositions comprise greater than about 25% by weight of the filler, most preferably greater than about 50% by weight. Such fillers may also include up to about 75%, preferably less than about 50% by weight of an admixture of other fillers, such as calcium carbonates, magnesium oxides, and magnesium carbonates, for example, hydromagnesite, as cigarette paper fillers, to reduce sidestream smoke without the negative subjectives associated with the use of magnesium hydroxide alone.

To prepare the papers of the invention, conventional cigarette paper manufacturing procedures may be used with the substitution of the magnesite/brucite aggregates alone, or in combination with the magnesite/brucite agglomerates, with or without an admixture of other fillers, for the conventional calcium carbonate filler. The paper wrappers of the invention may be made from any plant fibers, e.g., flax or other cellulose fibers. In addition, the paper wrappers of this invention may be a conventional one wrapper construction, a multiwrapped construction or a multilayer single wrap construction.

In order that the invention may be more fully understood, preferred compositions prepared and used in accordance with this invention are provided below by way of example.

EXAMPLES

Figure 1:
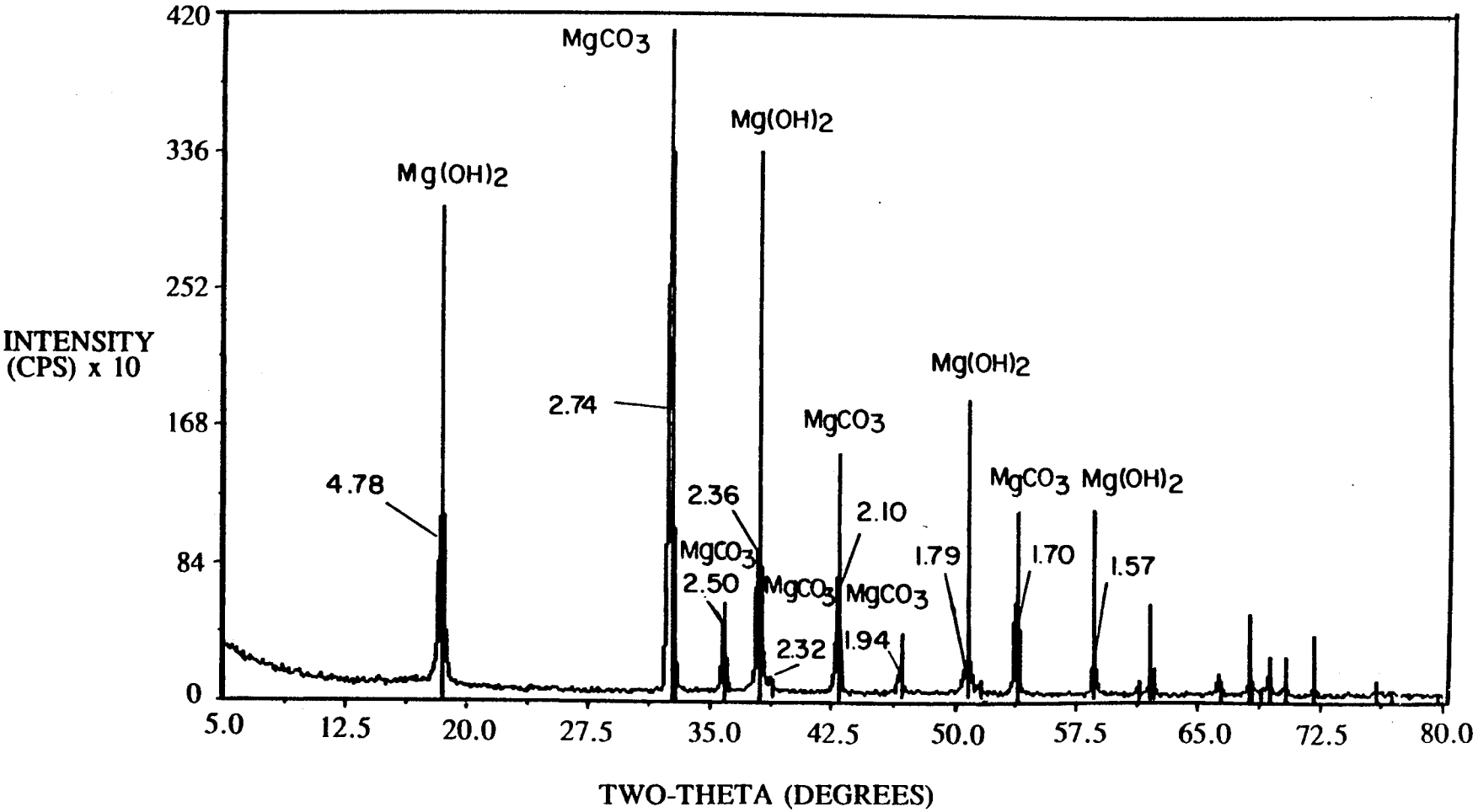
FIG. 1 is an x-ray powder diffraction pattern of a filler composition of the invention. The characteristic powder diffraction patterns of magnesite ($MgCO_3$, JCPDS 8-479) and magnesium hydroxide ($Mg(OH)_2$, JCPDS 7-239) are depicted. The sample analyzed was obtained from the filler described in Example 2.

The x-ray diffraction pattern of the composition described in Example 2 was obtained using a Siemens D500 automated powder diffractometer with a graphite monochromator. The instrument was set up with a Cu radiation ($\lambda = 1.54$Å) x-ray source operating at 50 kV and 40 mA. The two-theta scan range was set from about 5° C. to about 80° C. using a step scan window of 0.05°/1.0 second step. Beam slits were set at 1°, 1°, 1°, 0.15°, and 0.15° widths. Two-theta calibration was performed using an NBS mica standard (SRM 675). Data were collected and reduced with the use of a Micro VAX II computer. The data generated were plotted as shown in FIG. 1.

Figure 2:
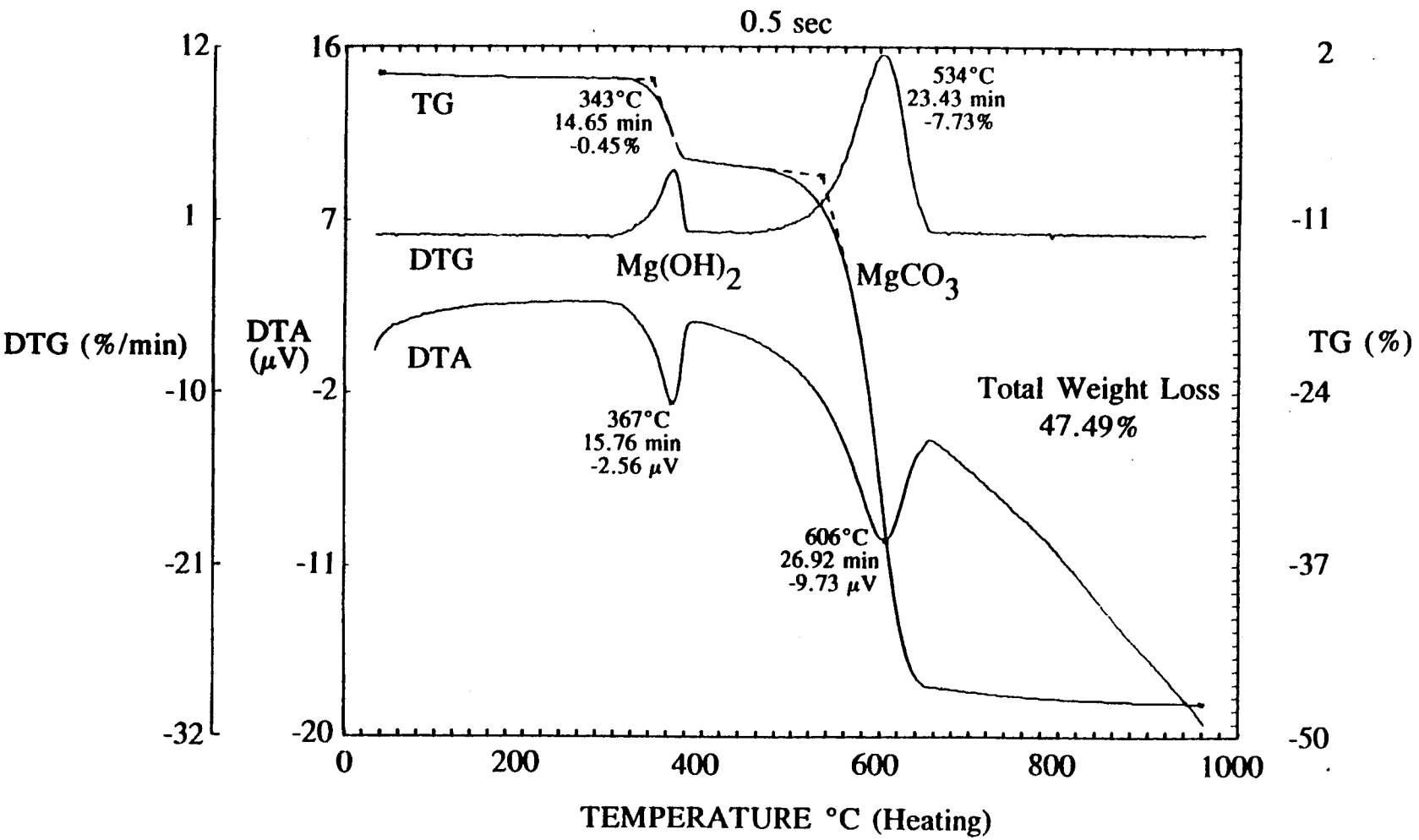
FIG. 2 is a plot of the thermal decomposition of a filler composition of the invention. Plotted as a function of temperature are the weight loss of the sample (TG), the derivative thereof (DTG), and the temperature difference between the sample and a reference (DTA).

Thermal decomposition analysis of the composition described in Example 2 below was conducted by placing approximately 5 mg of the solid reaction product in a Seiko Instruments Inc. thermal analysis instrument (TG/DTA 300). The weight of the solid sample was determined and recorded every half second as the sample was heated to approximately 950° C. at a rate of about 20° C. per minute. The data generated were plotted as shown in FIG. 2.

To measure the amount of sidestream smoke generated, burning cigarettes are allowed to free burn while the sidestream smoke travels through a cell through which light is passed. A photocell detects the transmitted light intensity during the burning of 30 millimeters of the tobacco rod. The measured light intensity over the course of burning is determined and compared to the light intensity when no smoke is present in the cell. An extinction coefficient (EC) measuring the amount of sidestream smoke generated is calculated based on the Beer-Lambert law.

Table 1 shows the percent reduction in visible sidestream smoke as calculated from various extinction coefficients of the test samples versus a control. The control is either a typical 85 or 100 millimeter commercial cigarette having a 25 gram per square meter paper wrapper having a calcium carbonate filler with a porosity of about 30 CORESTA units and a potassium citrate sizing agent. Test cigarettes were made by hand at comparable packing densities using the same tobacco filler as the control. All test samples were of standard circumference (about 25 millimeters) and about 85 to 100 millimeters in length including a 27 millimeter cellulose acetate filter.

Static Burn Time (SBT) is the amount of time it takes a cigarette to burn 40 millimeters under static conditions. In other words, it is the rate at which a cigarette smolders in the absence of uncontrolled drafts or puffing action. In the table below, SBT is expressed in terms of minutes, basis weight is in terms grams per square meter, porosity is in CORESTA units, and sizing is in weight percent.

EXAMPLE 1

Approximately 91 grams of a magnesium hydroxide paste (about 30% solids) were slurried in 150 milliliters of water in a 450 mL hydrothermal pressure reactor. The pressure reactor was charged with approximately 830 psi of carbon dioxide (about 0.47 moles, assuming 200 mL free volume at 20° C.) and heated to about 200° C. The reaction was allowed to continue for approximately 48 hours at which point it was cooled to room temperature where 100 psi of pressure were observed. The composition was then filtered, washed and air dried.

From thermal analysis it was determined that about 98% by weight of the resulting composition was magnesite and about 2% by weight was brucite. As seen in the electron micrograph of FIG. 3, the resulting composition contained magnesite/brucite aggregates. The two morphologies of magnesite and brucite can be clearly seen.

The resulting composition was then used as a filler in handsheets on about a thirty percent by weight basis. A handsheet with a basis weight of about 45.5 grams per square meter was prepared and sized with about 6.4% by weight potassium succinate giving a paper with a porosity of about 3.5 CORESTA units. The handsheet was then used to make sample cigarettes which were analyzed for static burn time and extinction coefficient. The results of these analyses are reported in Table 1 below.

EXAMPLE 2

Following the procedure described in Example 1, approximately 91 grams of a magnesium hydroxide paste (about 30% solids) were slurried in about 150 milliliters of water in a 450 mL hydrothermal pressure reactor. The pressure reactor was charged with approximately 700 psi of carbon dioxide (about 0.40 moles, assuming 200 mL free volume at 20° C.) and heated to about 200° C. The reaction was allowed to continue for approximately 24 hours at which point it was cooled to room temperature where 150 psi of pressure were observed. The composition was then filtered, washed and air dried. The final composition was analyzed by x-ray powder diffraction (FIG. 1), thermal analysis (FIG. 2), and scanning electron microscopy (FIG. 4).

In FIG. 1, the characteristic lines of the powder patterns for magnesite and brucite can be seen. FIG. 2 shows thermal decompositions characteristic of brucite (onset at about 343° C.) and magnesite (onset at about 534° C.). From the total weight loss of the thermal analysis, the percentage of magnesite and brucite in the composition was calculated to be about 78% and 22% by weight, respectively. Representative magnesite/brucite aggregates are shown in the electron micrograph of FIG. 4.

The resulting composition was then used as a filler in handsheets on about a thirty percent by weight basis. A handsheet with a basis weight of about 45.7 grams per square meter was prepared and sized with about 5.1% by weight potassium succinate giving a paper with a porosity of about 4.5 CORESTA units. The handsheet was then used to make sample cigarettes which were analyzed for static burn time and extinction coefficient. The results of these analyses are reported in Table 1 below.

EXAMPLE 3

Following the procedure described in Example 1, approximately 91 grams of a magnesium hydroxide paste (about 30% solids) were slurried in about 150 milliliters of water in a 450 mL hydrothermal pressure reactor. The pressure reactor was charged with approximately 500 psi of carbon dioxide (about 0.28 moles, assuming 200 mL free volume at 20° C.) and heated to about 200° C. The reaction was allowed to continue for approximately 20 hours at which point it was cooled to room temperature where 20 psi of pressure were observed. The composition was then filtered, washed and air dried.

X-ray powder diffraction confirmed the presence of both magnesite and brucite in the resulting composition. From the thermal analysis it was determined that about 71% by weight of the resulting composition was magnesite and about 29% by weight was brucite. An electron micrograph of the magnesite/brucite aggregate is shown in FIG. 5.

The resulting composition was then used as a filler in handsheets on about a thirty percent by weight basis. A handsheet with a basis weight of about 45.2 grams per square meter was prepared and sized with about 6.6% by weight potassium succinate giving a paper with a porosity of about 3.8 CORESTA units. The handsheet was then used to make sample cigarettes which were analyzed for static burn time and extinction coefficient. The results of these analyses are reported in Table 1 below.

EXAMPLE 4

Following the procedure described in Example 3, a similar preparation was undertaken except the residual pressure in the cooled reactor was about 120 psi. The composition was filtered, washed and air dried. From the thermal analysis it was determined that about 47% by weight of the resulting composition was magnesite and about 53% by weight was brucite. An electron micrograph of the magnesite/brucite aggregate is shown in FIG. 6.

The resulting composition was then used as a filler in handsheets on about a thirty percent by weight basis. A handsheet with a basis weight of about 43.2 grams per square meter was prepared and sized with about 7.5% by weight potassium succinate giving a paper with a porosity of about 5.0 CORESTA units. The handsheet was then used to make sample cigarettes which were analyzed for static burn time and extinction coefficient. The results of these analyses are reported in Table 1.

EXAMPLE 5

Approximately 45 grams of a basic magnesium carbonate (hydromagnesite) were slurried in about 200 milliliters of water in a 450 mL hydrothermal pressure reactor. The reactor was heated to about 200° C., held for approximately 48 hours under autogenous pressure, and allowed to cool to room temperature. The composition was then filtered, washed and air dried.

From the thermal analysis it was determined that about 85% by weight of the resulting composition was magnesite and about 15% by weight was brucite. The electron micrograph shown in FIG. 7 shows separate agglomerates of brucite particles interspersed amongst magnesite particles.

The resulting composition was then used as a filler in handsheets on about a thirty percent by weight basis. A handsheet with a basis weight of about 44.9 grams per square meter was prepared and sized with about 6.2% by weight potassium succinate giving a paper with a porosity of about 4.6 CORESTA units. The handsheet was then used to make sample cigarettes which were analyzed for static burn time and extinction coefficient. The results of these analyses are reported in Table 1.

EXAMPLE 6

Following the procedure described in Example 5, a similar preparation was undertaken at a reactor temperature of about 180° C. From the thermal analysis it was determined that about 85% by weight of the resulting composition was magnesite and about 15% by weight was brucite. An electron micrograph of the magnesite/brucite agglomerate is shown in FIG. 8.

The resulting composition was then used as a filler in handsheets on about a thirty percent by weight basis. A handsheet with a basis weight of about 45.8 grams per square meter was prepared and sized with about 7.8% by weight potassium succinate giving a paper with a porosity of 4.2 CORESTA units. The handsheet was then used to make sample cigarettes which were analyzed for static burn time and extinction coefficient. The results of these analyses are reported in Table 1.

EXAMPLE 7

40.0 grams of a basic magnesium carbonate (hydromagnesite) and 11.8 grams of potassium bicarbonate ($KHCO_3$) were mixed in about 200 milliliters of water in a 450 mL hydrothermal pressure reactor. The reactor was heated to about 180° C., held for approximately 48 hours under autogenous pressure, and allowed to cool to room temperature. The composition was then filtered, washed and air dried. X-ray powder diffraction confirmed the presence of both magnesite and brucite in the resulting composition. From the thermal analysis it was determined that about 90% by weight of the resulting composition was magnesite and about 10% by weight was brucite. An electron micrograph of the magnesite/brucite agglomerate is shown in FIG. 9.

The resulting composition was then used as a filler in handsheets on about a thirty percent by weight basis. A handsheet with a basis weight of about 45.4 grams per square meter was prepared and sized with about 6.2% by weight potassium succinate giving a paper with a porosity of about 5.7 CORESTA units. The handsheet was then used to make sample cigarettes which were analyzed for static burn time and extinction coefficient. The results of these analyses are reported in Table 1.

EXAMPLE 8

Approximately 100.0 grams of magnesium hydroxide powder and 295.3 grams of potassium bicarbonate were mixed in about 1000 milliliters of water in a 2000 mL hydrothermal pressure reactor. The reactor was heated to about 180° C., held for 24 hours under autogenous pressure, and allowed to cool to room temperature. The composition was then filtered, washed and air dried. From the thermal analysis it was determined that about 92% by weight of the resulting composition was magnesite and about 8% by weight was brucite. An electron micrograph of the magnesite/brucite agglomerate is shown in FIG. 10.

The resulting composition was then used as a filler in handsheets on about a thirty percent by weight basis. A handsheet with a basis weight of about 45.2 grams per square meter was prepared and sized with about 7.9% by weight potassium succinate giving a paper with a porosity of about 3.6 CORESTA units. The handsheet was then used to make sample cigarettes which were analyzed for static burn time and extinction coefficient. The results of these analyses are reported in Table 1.

TABLE 1

| Example | Basis Wt. | CORESTA Porosity | Sizing | SBT | EC | % EC Reduction* |
|---|---|---|---|---|---|---|
| 1 | 45.5 | 3.5 | 6.4 | 9.7 | 0.32 | 62 |
| 2 | 45.7 | 4.5 | 5.1 | 11.4 | 0.31 | 63 |
| 3 | 45.2 | 3.8 | 6.6 | 9.9 | 0.33 | 61 |
| 4 | 43.2 | 5.0 | 7.5 | 9.6 | 0.24 | 71 |
| 5 | 44.9 | 4.6 | 6.2 | 9.2 | 0.31 | 61 |
| 6 | 45.8 | 4.2 | 7.8 | 8.9 | 0.27 | 58 |
| 7 | 45.4 | 5.7 | 6.2 | 8.0 | 0.38 | 49 |
| 8 | 45.2 | 3.6 | 7.9 | 7.9 | 0.40 | 47 |

*Percent reduction as compared to the control.

One skilled in the art will appreciate that the present invention may be practiced by other than the preferred embodiments which are presented for purposes of illustration and not limitation, and that the present invention is defined by the claims that follows.

REFERENCES (1) Shlyapnikov, D. S., Shtern, E. K., Demchuk, I. G., Sherstobitova, L., Dokl. Akad. Nauk SSSR, 265(3), 701-5 (1982).
(2) Shlyapnikov, D. S., Shtern, E. K., Demchuk, I. G., Dokl. Akad. Nauk SSSR, 252(4), 962-6 (1980).
(3) Shlyapnikov, D. S., Shtern, E. K., Petrishcheva, V. G., Ezhegodnik 1978. Inform. Materialy. In-t Geol. i Geokhimii. Ural'sk. Nauch. Tsentr AN SSSR., Sverdlovsk, 132-4 (1979).
(4) Shlyapnikov, D. S., Shtern, E. K., Petrishcheva, V. G., Dokl. Akad. Nauk SSSR, 247(3), 706-11 (1979).

What is claimed is:

1. A paper suitable for use as a smoking article wrapper comprising plant fiber and a co-crystalline composition of magnesite and brucite.

2. The paper wrapper of claim 1 wherein at least about 25% by weight of the composition is between about 98% and 40% magnesite by weight of said composition and between about 2% and 60% brucite by weight of said composition.

3. The paper according to claim 2 having a basis weight of between about 25 to 75 grams per square meter.

4. The paper according to claim 2 having a porosity of between about 2 and 15 CORESTA units.

5. The paper according to any of claims 2, 6 or 7 further comprising between about 2% and 15% by weight of a sizing agent.

6. The paper according to claim 5 wherein the sizing agent comprises of an alkali metal salt of an acid.

7. The paper according to claim 6 wherein the alkali metal salt of an acid is selected from sodium fumarate, sodium citrate, potassium citrate, potassium succinate, potassium dihydrogen phosphate, and combinations thereof.

8. A paper suitable for use as a smoking article wrapper comprising plant fiber; between about 15% and 45% by weight of a filler, said filler comprising a co-crystalline magnesite/brucite composition, said magnesite comprising between about 98% and 40% by weight of said composition and said brucite comprising between about 2% and 60% by weight of said composition; between about 2% and 15% by weight of a sizing agent; said paper having a porosity of between about 2 and 15 COREST units.

9. The paper according to claim 8 having a basis weight of between about 25 and 75 grams per square meter.

10. A paper suitable for use as a smoking article wrapper comprising plant fibers; between about 15% and 45% by weight filler, said filler comprising at least about 25% by weight of a co-crystalline magnesite/brucite composition, said composition comprising between about 98% and 40% by weight magnesite and between about 2% and 60% by weight brucite, and said filler further comprising up to about 75% by weight of an admixture of at least one compound selected from the group consisting of inorganic oxides and inorganic carbonates.

11. The paper according to claim 10 wherein said admixture comprises calcium carbonate.

12. The paper according to claim 10 wherein said admixture comprises magnesium oxide.

13. The paper according to claim 10 wherein said admixture comprises hydromagnesite.

14. The paper according to any one of claims 10, 11, 12, or 13 further having a basis weight of between about 25 and 75 grams per square meter.

15. The paper according to claim 14 further having a porosity of between about 2 and 15 CORESTA its.

16. The paper according to claim 15 further comprising between about 2% and 15% by weight of a sizing agent.

17. The paper according to claim 16 wherein the sizing agent comprises an alkali metal salt of an acid.

18. The paper according to claim 17 wherein the alkali metal salt of an acid is selected from sodium fumarate, sodium citrate, potassium citrate, potassium succinate, potassium dihydrogen phosphate, and combinations thereof.

19. A smoking article having reduced sidestream smoke comprising a tobacco rod enveloped by a paper wrapper, said paper wrapper comprising plant fiber and a filler comprising a co-crystalline magnesite/brucite composition, wherein said magnesite comprises between about 98% and 40% by weight of said composition and said brucite comprises between about 2% and 60% by weight of said composition.

20. The smoking article according to claim 19 wherein said paper wrapper has a porosity of between about 2 and 15 CORESTA units.

21. The smoking article according to claim 19 wherein said paper wrapper has a basis weight of between about 25 and 75 grams per square meter.

22. The smoking article according to any one of claims 19, 20 or 21 wherein said paper wrapper further comprises between about 2% and 15% by weight of a sizing agent.

23. The smoking article according to claim 22 wherein the sizing agent comprises an alkali metal salt of an acid.

24. The smoking article according to claim 23 wherein the alkali metal salt of an acid is selected from sodium fumarate, sodium citrate, potassium citrate, potassium succinate, potassium dihydrogen phosphate, and combinations thereof.

25. A smoking article comprising a tobacco rod enveloped by a paper wrapper, said paper wrapper comprising plant fiber, between about 15% and 45% by weight of a filler, said filler comprising at least about 25% by weight of a co-crystalline magnesite/brucite composition, said composition comprising between about 98% and 40% by weight of magnesite and between about 2% and 60% by weight of brucite, said paper further comprising between about 2% and 15% by weight of a sizing agent.

26. The smoking article according to claim 25, said paper wrapper further defined as having a basis weight of between about 25 and 75 grams per square meter.

27. The smoking article according to claim 25, said paper wrapper further defined as having a porosity of between about 2 and 15 CORESTA units.

28. A smoking article having reduced sidestream smoke comprising a tobacco rod enveloped by a paper wrapper, said paper wrapper comprising plant fiber and between about 15% and 45% by weight filler, said filler comprising at least about 25% by weight of a co-crystalline magnesite/brucite composition, said composition comprising between about 98% and 40% magnesite and between about 2% and 60% brucite, said filler further comprising up to about 75% by weight of an admixture of at least one compound selected from the group consisting of inorganic oxides and inorganic carbonates.

29. The smoking article according to claim 28 wherein said admixture comprises magnesium oxide.

30. The smoking article according to claim 28 wherein said admixture comprises calcium carbonate.

31. The smoking article according to claim 28 wherein said admixture comprises hydromagnesite.

32. The smoking article according to any one of claims 28, 29, 30 or 31 wherein said paper wrapper has a basis weight of between about 25 and 75 grams per square meter.

33. The smoking article according to claim 32 wherein said paper wrapper has a porosity of between about 2 and 15 CORESTA units.

34. The smoking article according to claim 33 wherein said paper wrapper further comprises between about 2% and 15% by weight of a sizing agent.

35. The smoking article according to claim 34 wherein the sizing agent comprises an alkali metal salt of an acid.

36. The smoking article according to claim 35 wherein the alkali metal salt of an acid is selected from sodium fumarate, sodium citrate, potassium citrate, potassium succinate, potassium dihydrogen phosphate, and combinations thereof.

* * * * *